US009315308B2

(12) United States Patent
Audet et al.

(10) Patent No.: US 9,315,308 B2
(45) Date of Patent: Apr. 19, 2016

(54) RECEPTACLE TOP WITH REMOVABLE DUST PAN LID

(71) Applicant: United Comb & Novelty Corporation, Leominster, MA (US)

(72) Inventors: Ronald Audet, North Smithfield, RI (US); Rebecca B. Foster, West Lebanon, NH (US); Theresa Scalzi, Concord, MA (US)

(73) Assignee: United Comb + Novelty Corporation, Leominister, MA (US)

( * ) Notice: Subject to any disclaimer, the term of this patent is extended or adjusted under 35 U.S.C. 154(b) by 0 days.

(21) Appl. No.: 14/607,171

(22) Filed: Jan. 28, 2015

(65) Prior Publication Data

US 2015/0360833 A1 Dec. 17, 2015

Related U.S. Application Data

(60) Provisional application No. 62/011,219, filed on Jun. 12, 2014.

(51) Int. Cl.

| | |
|---|---|
| ***B65D 51/24*** | (2006.01) |
| ***A47L 13/52*** | (2006.01) |
| ***B65F 1/14*** | (2006.01) |

(52) U.S. Cl.

CPC ..... *B65D 51/24* (2013.01); *A47L 13/52* (2013.01); *B65F 1/1607* (2013.01); *B65F 2210/136* (2013.01)

(58) Field of Classification Search

CPC ..... B65F 1/16; B65F 2210/136; B65F 1/14; Y10S 220/908; A47L 13/52

See application file for complete search history.

(56) References Cited

U.S. PATENT DOCUMENTS

| | | | | |
|---|---|---|---|---|
| 3,156,941 | A * | 11/1964 | Tomaiuolo | 15/257.1 |
| 3,382,523 | A * | 5/1968 | Parsisson | 15/257.2 |
| 3,390,804 | A * | 7/1968 | Morgan | 220/212 |
| 4,649,813 | A * | 3/1987 | Kehl | 100/227 |
| 5,172,823 | A * | 12/1992 | Moetteli | 220/212 |
| 5,407,089 | A * | 4/1995 | Bird et al. | 220/212.5 |
| 5,611,450 | A * | 3/1997 | DeMars | 220/212 |
| 5,924,162 | A * | 7/1999 | Kalscheur et al. | 15/257.2 |
| 6,820,628 | B2 * | 11/2004 | Larson | A01B 1/02 135/66 |
| 2001/0045371 | A1 * | 11/2001 | Ordonez | 206/499 |
| 2006/0261143 | A1 * | 11/2006 | Sola Barbarin et al. | 232/43.1 |

* cited by examiner

*Primary Examiner* — Jeffrey Allen

(74) *Attorney, Agent, or Firm* — Brian M. Dingman; Dingman, McInnes & McLane, LLP

(57) ABSTRACT

A receptacle top with a brush and a lid, from which the lid may be removed in order to be utilized as a dust pan and then returned to the top to be utilized as an aesthetic lid. The brush may be stored on the exterior of the cover or it may be stored within the body of the lid, thereby allowing the tools required for cleaning to be in one convenient location.

14 Claims, 14 Drawing Sheets

RECEPTACLE TOP WITH REMOVABLE DUST PAN LID

CROSS-REFERENCE TO RELATED APPLICATION

This application claims benefit from U.S. Provisional Patent Application No. 62/011,219, filed Jun. 12, 2014, the contents of which are incorporated herein by reference.

FIELD

This disclosure relates to a receptacle lid.

BACKGROUND

The clean-up of debris on the floor often requires a receptacle in which to place the debris and a dust pan and brush to employ in the gathering of the debris from the floor. The typical routine would involve walking to the closet or nearby hanging or storage area to find the dust pan and brush, and then back to the spill area, and then to the receptacle. The receptacle top is then moved aside to deposit the debris and then the top is returned to its closed position. Upon completing the clean-up, one typically has to return the dust pan and brush to their storage places where they were found.

SUMMARY

The device disclosed herein is a receptacle top consisting of a brush, a cover, and a lid which also functions as a dust pan. The lid and brush are always with the receptacle so a trip elsewhere to acquire a dust pan and brush is not necessary. After gathering the debris with the lid, when functioning as a dust pan, one is not required to move aside the receptacle top in order to deposit the debris. The receptacle top described herein is open while the lid is functioning as a dust pan and then upon completing the clean-up, one simply returns the lid to its storage position as the lid on the receptacle top. This receptacle top allows the user to have all necessary tools in the same place while maintaining the aesthetic qualities of the receptacle. The brush used along with the lid may be stored on the cover or the lid, allowing its discrete storage while remaining in the proximity of the receptacle at all times.

The disclosure features a receptacle top which rests upon a trash receptacle. In one embodiment the receptacle top consists of a cover, a brush and a lid. The cover has an edge which rests over the top rim of the receptacle and it extends downward in order to maintain the lateral position of the cover upon the receptacle. The cover may provide support for the lid with support posts or support post slots. The lid may be constructed with opposing support post slots or support posts, respectively. This allows the lid to rest upon the cover when in its storage position. In an embodiment which includes support posts on the cover, the posts provide places upon which the lid may rest, while also providing an axis around which the lid may rotate within the support post slots on the lid. This allows the storage position of the lid to be the closed position of the receptacle top. The front of the lid may be pushed downward, providing an opening through which debris may be deposited into the receptacle. The lid is constructed to fit aesthetically on the cover upon its support posts. In this embodiment the lid may be lifted from the support posts in order to function as a dust pan. The lid may be constructed with an integral handle protruding from its rear side, opposing the edge over which debris may be swept and collected. The handle of the lid is an extension of the lid itself and fits within the cover opening so it swings freely upon the support posts when being used as the lid for the receptacle, the storage position of the lid.

The cover may be constructed to support a brush which may be stored in or on the cover or the lid. The brush may be constructed appropriately in order to effectively reside in or on a brush storage location which may exist somewhere on the body of the cover or lid. In one embodiment the lid is constructed to provide a storage location for the brush. The bristle end of the brush may reside within a slot at the edge of the storage location for the brush and the handle end of the brush may reside within a hole at the edge of the storage location for the brush. This allows for discrete storage of the brush within the lid, and provides a secure method of shipping the receptacle top, as a whole, when the lid is in its storage position upon the cover.

DETAILED DESCRIPTION

Figure 1:
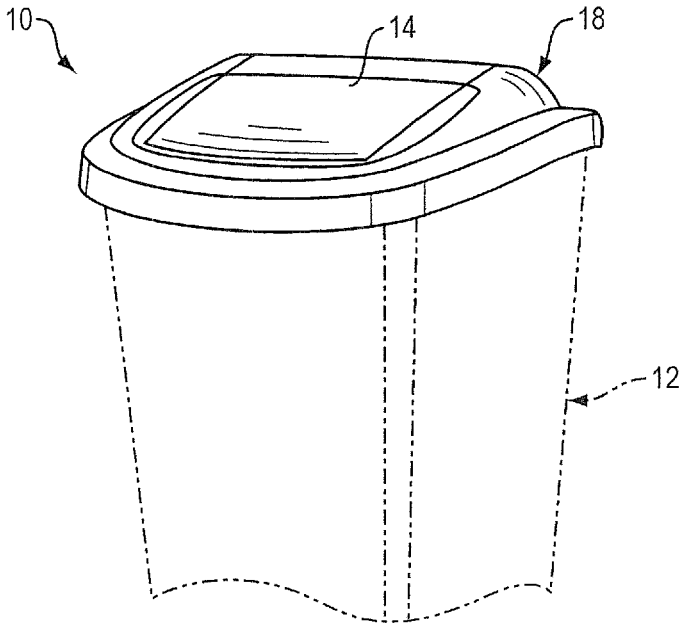
FIG. 1 is an angled view of a receptacle top with a closed lid upon a cover which rests upon the receptacle.

The device disclosed herein is a top for a receptacle, the top consisting of a cover, a lid, and a brush. FIG. 1 shows an embodiment of the receptacle top 10 resting upon an open-top receptacle 12. The lid 14 is resting upon the cover 18 and is in a closed storage position.

Figure 2:
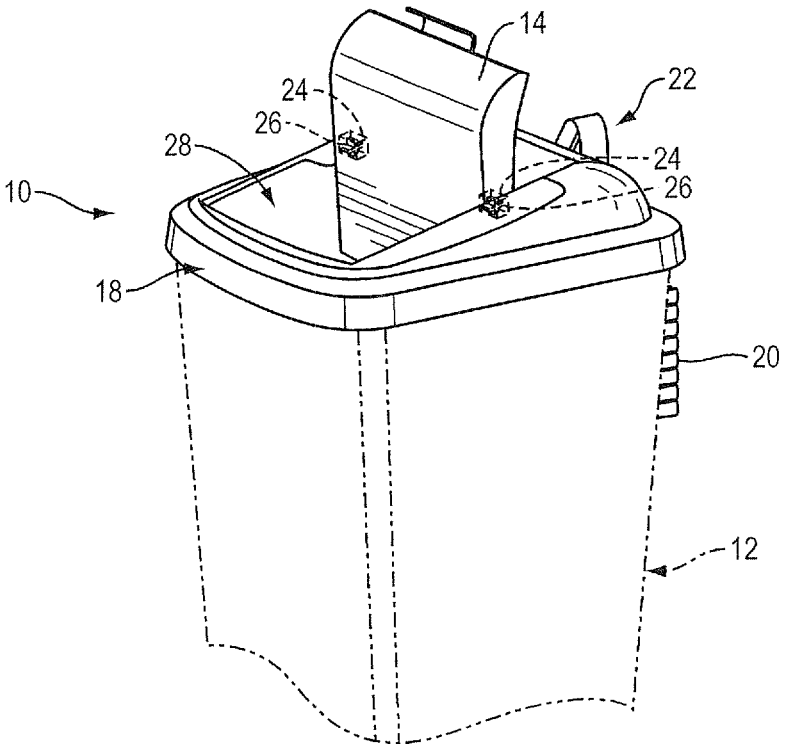
FIG. 2 is an angled view of a receptacle top with a lid which has been pushed open upon the cover, the cover resting upon the receptacle and the brush resting upon the cover.

FIG. 2 shows an embodiment of the receptacle top 10 resting upon a receptacle 12. The lid 14 is resting in its storage position upon the cover 18 and is in an open orientation. In this embodiment the brush 20 is stored in a brush storage location 22 on the rear of the cover 18. The lid 14 pivots with its support post slots 24 resting and turning upon the support posts 26 of the cover 18. This allows the user to gently push debris against the front of the resting lid 14, allowing the lid 14 to pivot in order to provide an open space 28 through the cover 18 into the receptacle 12. Upon completing the deposit of debris into the receptacle 12, through the open space 28, the lid 14 may pivot back to its closed position, as shown in FIG. 1. This eliminates the need for the user to open the receptacle 12 by removing lid 14, as is presently available to consumers. If one wishes to sweep debris from the floor, one may lift the lid 14 from its storage position upon the cover 18 and invert its orientation, thus altering its function from a lid to a dust pan. In this embodiment the user may utilize a brush 20 which hangs from the rear of the cover 18, to assist in collecting debris into the lid 14 when it is functioning as a dust pan. Once collected, the debris may be deposited into the receptacle 12 through the open space 28 created by the removal of the lid 14 when it is functioning as a dust pan. Ultimately, upon the completion of the clean-up, one may again invert the orientation of the lid 14 and reinstall it in its storage position upon the support posts 26 of the cover 18, thereby closing the opening 28.

Figure 3:
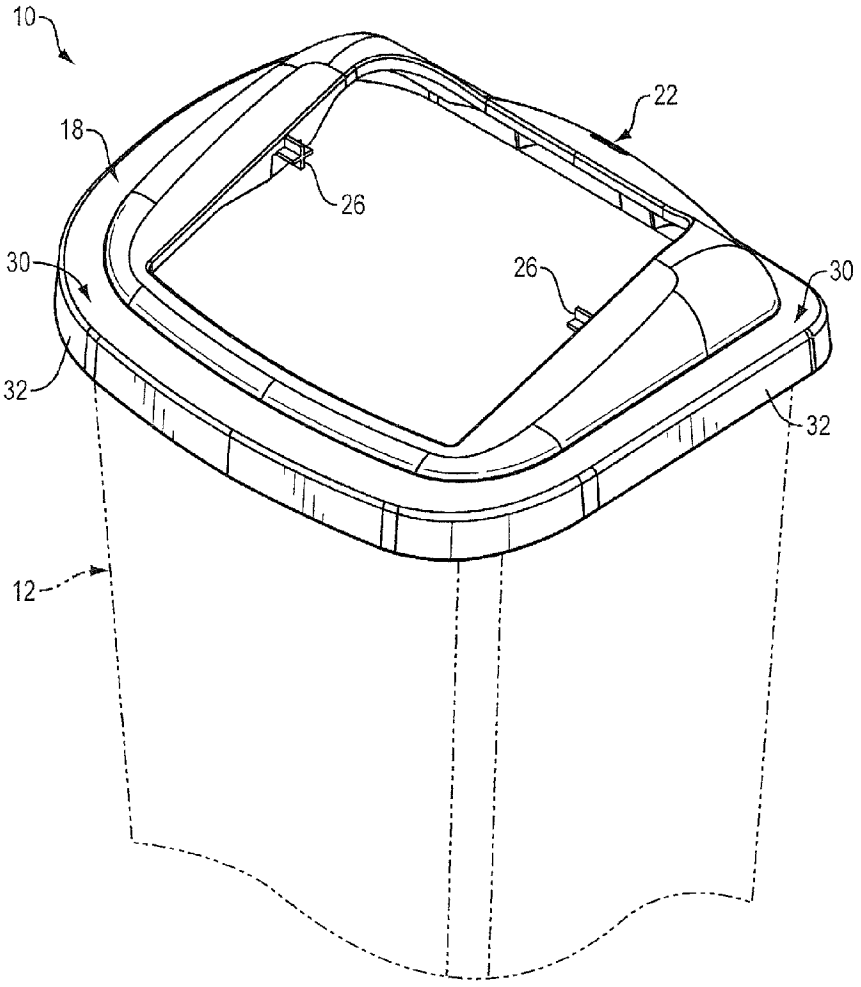
FIG. 3 is an angled view of a receptacle top with an open cover upon a receptacle, without the lid or the brush.

FIG. 3 shows an embodiment of a receptacle top 10 with its open cover 18 revealing its two support posts 26. The underside of flat portion 30 of the cover 18 is resting upon the top rim of open-top receptacle 12. The outer edge 32, which extends around the perimeter of the cover 18, is hanging over the top rim of the receptacle 12, maintaining the lateral position of the cover 18. A brush storage location 22 is shown on the rear portion of this embodiment of the cover 18.

Figure 4:
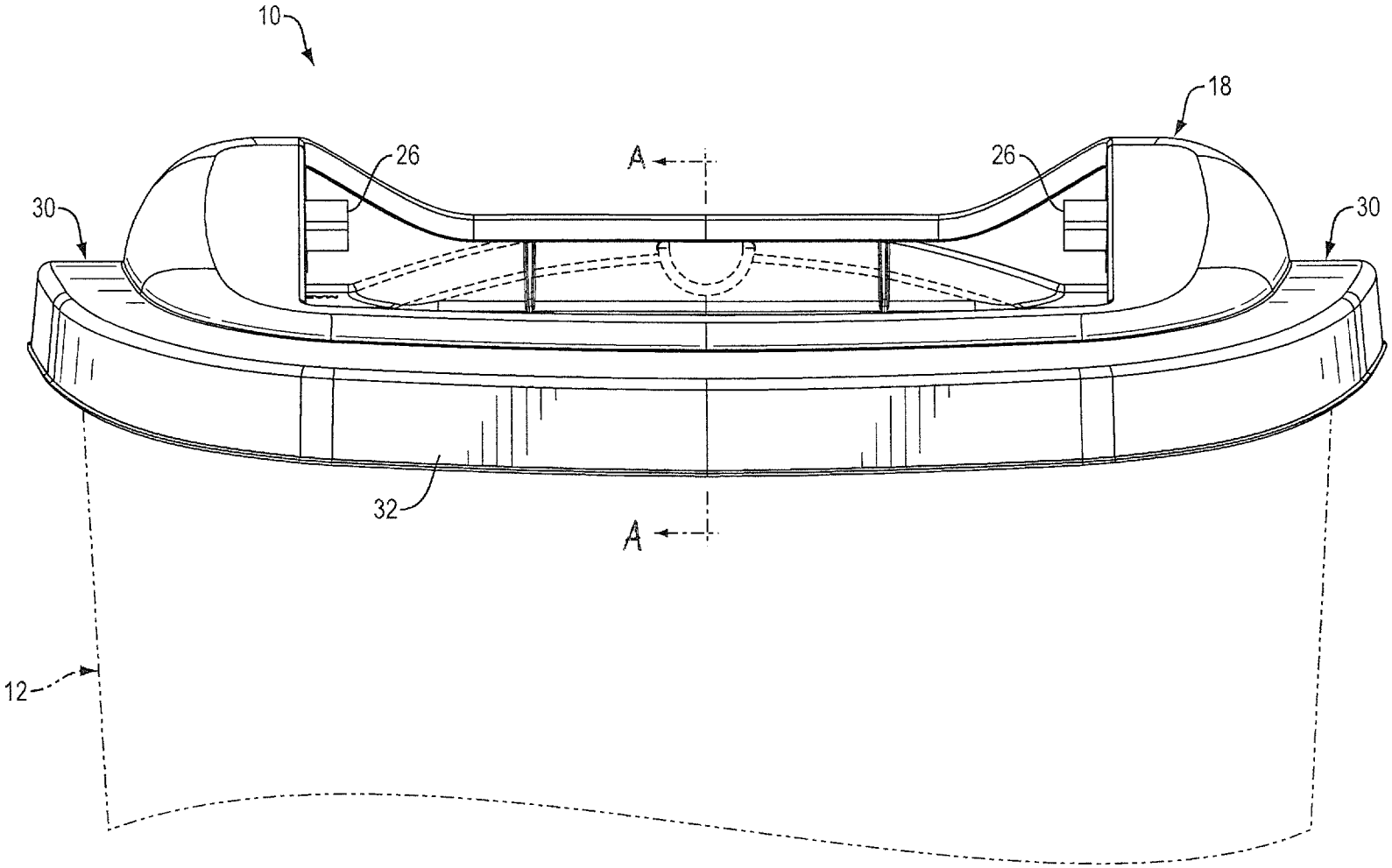
FIG. 4 is a front view of a receptacle top with an open cover upon a receptacle, without the lid or the brush.

FIG. 4 depicts a front view of a receptacle top 10 with its cover 18 resting upon the top rim of a receptacle 12. Support posts 26 are shown as well as a flat portion 30 of this embodiment of the cover 18. The flat portion 30 is adjacent and connected to the outer edge 32 of the cover 18.

Figure 5:
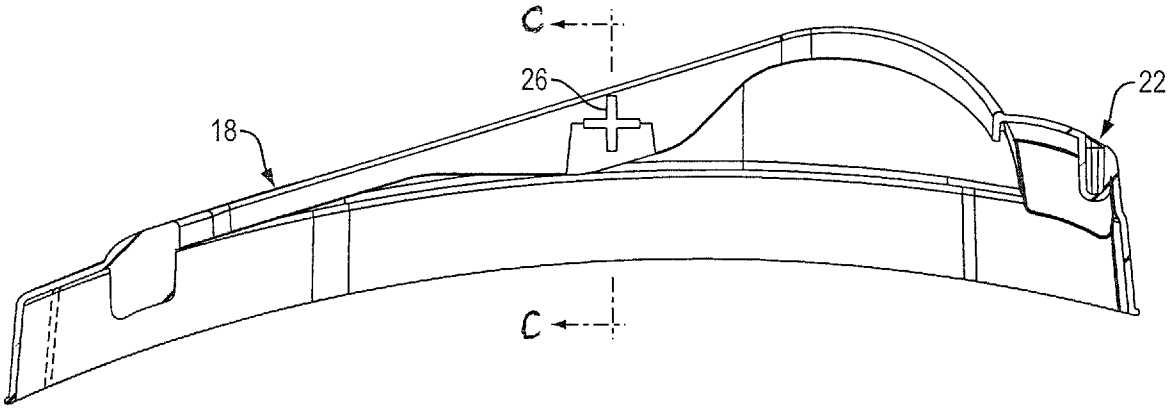
FIG. 5 is a cross-sectional view taken along line A-A of FIG. 4.

FIG. 5 is a cross-sectional view of the cover 18 taken along line A-A of FIG. 4. One of the support posts 26 is shown as well as a brush storage location 22 on the rear portion of the cover 18.

Figure 6:
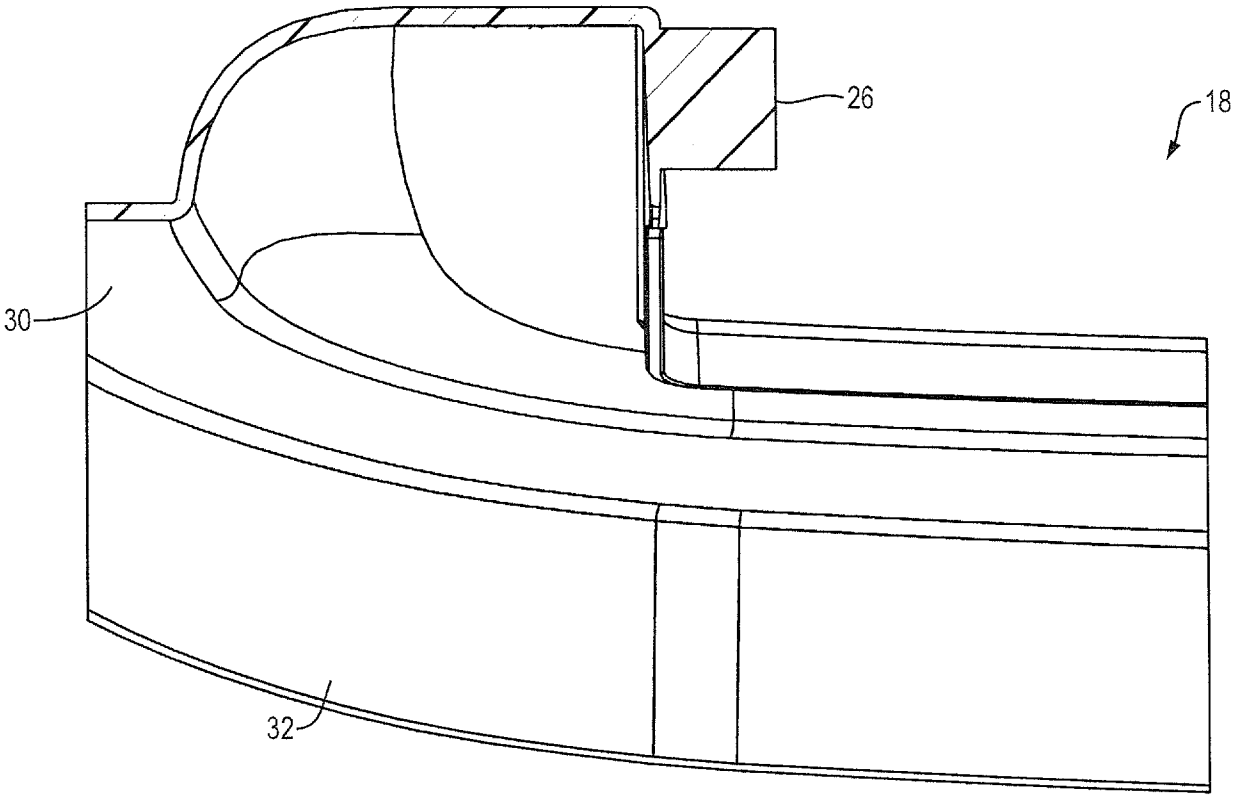
FIG. 6 is a cross-sectional view taken along line C-C of FIG. 5.

FIG. 6 is a cross-sectional view of the cover 18 taken along line C-C of FIG. 5 which provides a detailed view of cover edge 32 and the flat portion 30 of the cover 18, along with a cross-section of a support post 26.

Figure 7:
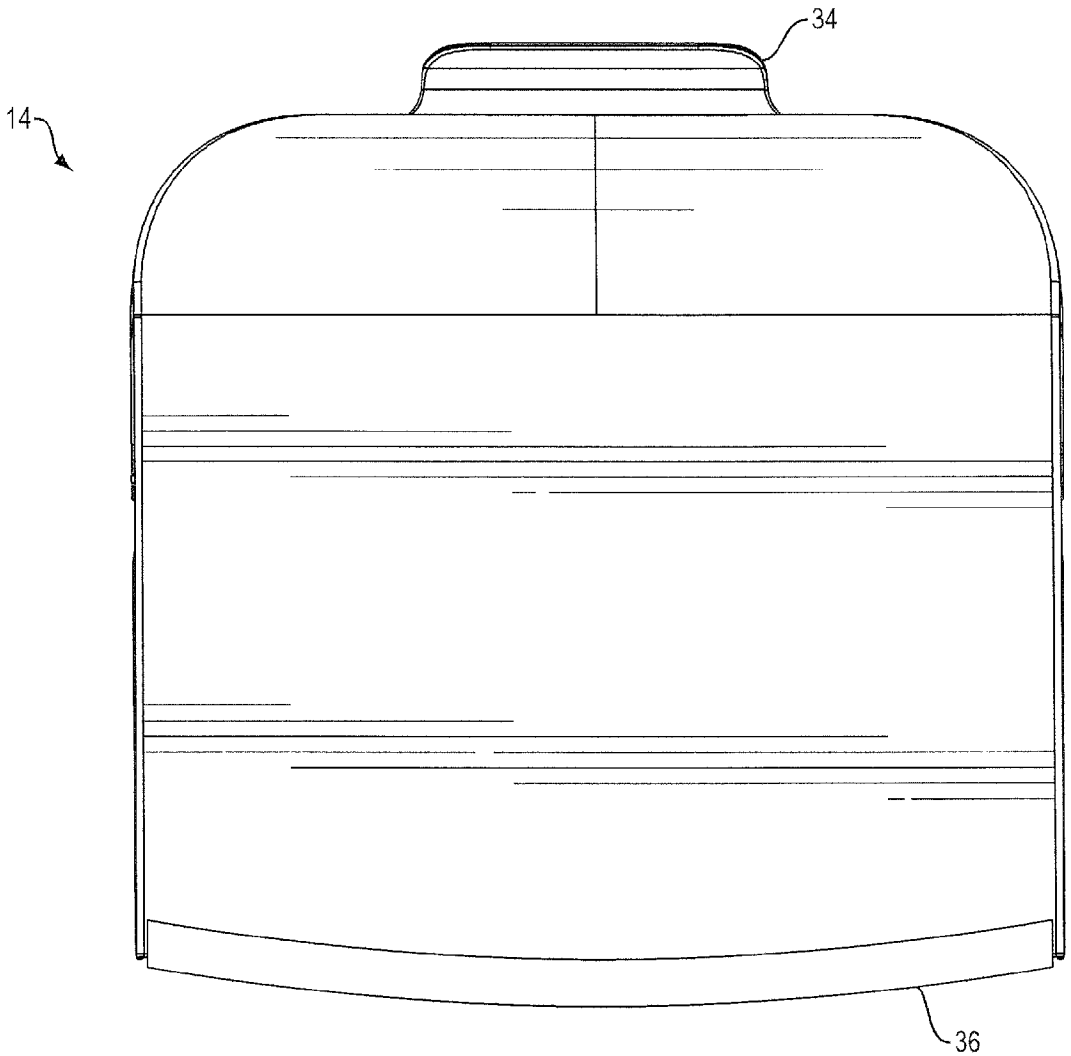
FIG. 7 is a top view of the lid as it would be situated upon the cover.

FIG. 7 depicts the top side of a lid 14 as it would be seen resting in its storage position. A handle 34 is shown opposing the edge 36 of a lid 14 in this embodiment.

Figure 8:
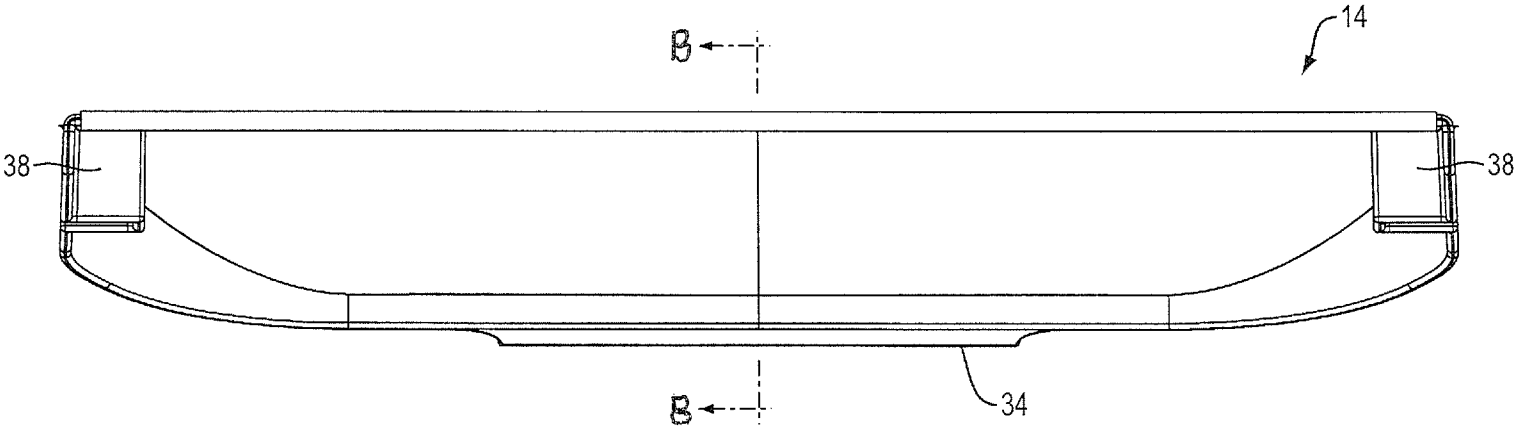
FIG. 8 is a front view of the lid as it would be situated upon the cover.

FIG. 8 is a front view of a lid 14 as it would be seen resting in its storage position. Support post slots 38 are used to rest in its storage position as shown in FIGS. 1-4. A handle 34 of the lid 14 in this embodiment is shown on the bottom of this figure.

Figure 9:
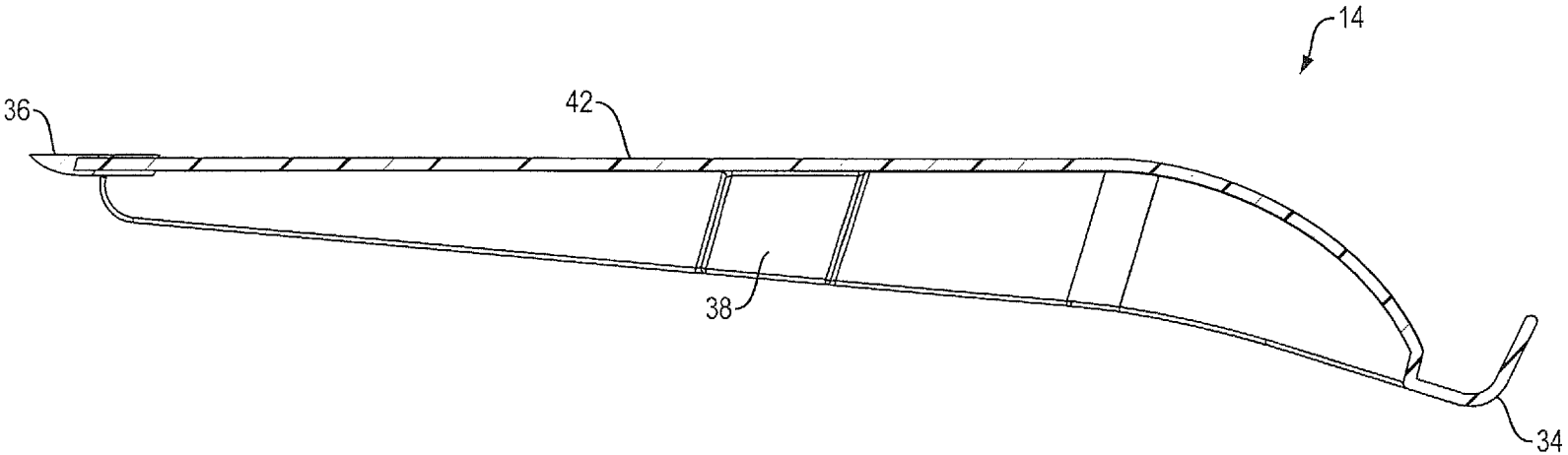
FIG. 9 is a cross-sectional view taken along line B-B of FIG. 8.

FIG. 9 is a cross-sectional view taken along line B-B of FIG. 8. This is a side view of a lid 14 as it would be seen resting in a storage position. The handle 34 is shown opposing the edge 36. A support post slot 38 is shown near the middle of the lid 14. In this embodiment, surface 42 is on top when the lid 14 is in its storage position. The same surface 42 is on the bottom when the lid 14 is functioning as a dust pan, having been removed from its storage position and inverted for use independently.

Figure 10A:
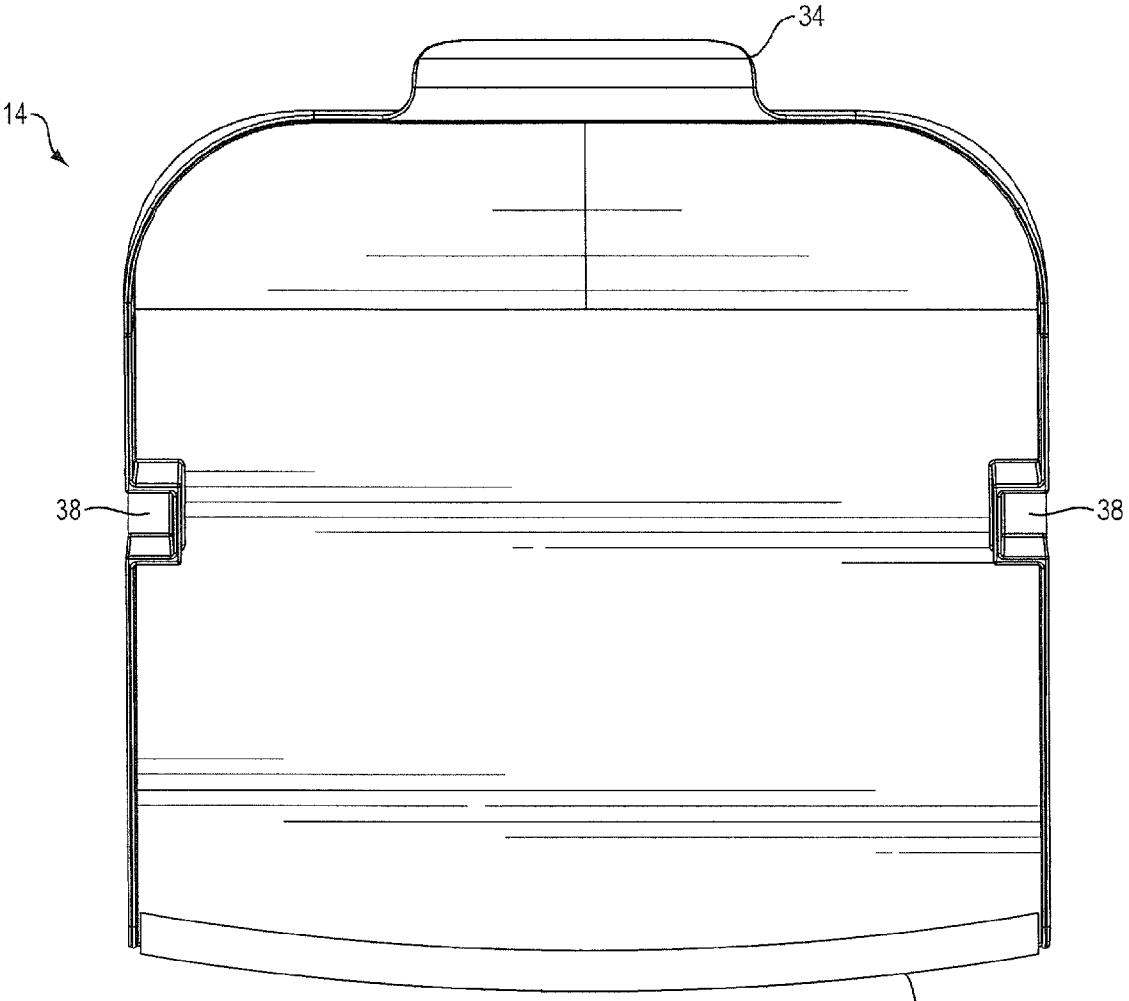
FIG. 10A is a bottom view of the lid when it has been removed from the cover to be used as a dust pan.

FIG. 10A depicts a lid 14 as seen when it is removed from its storage position and inverted for use independently as a dust pan. A handle 34 is shown opposing an edge 36 over which debris may be gathered. Support post slots 38 are shown on opposing sides of the lid 14 in this embodiment.

Figure 10B:
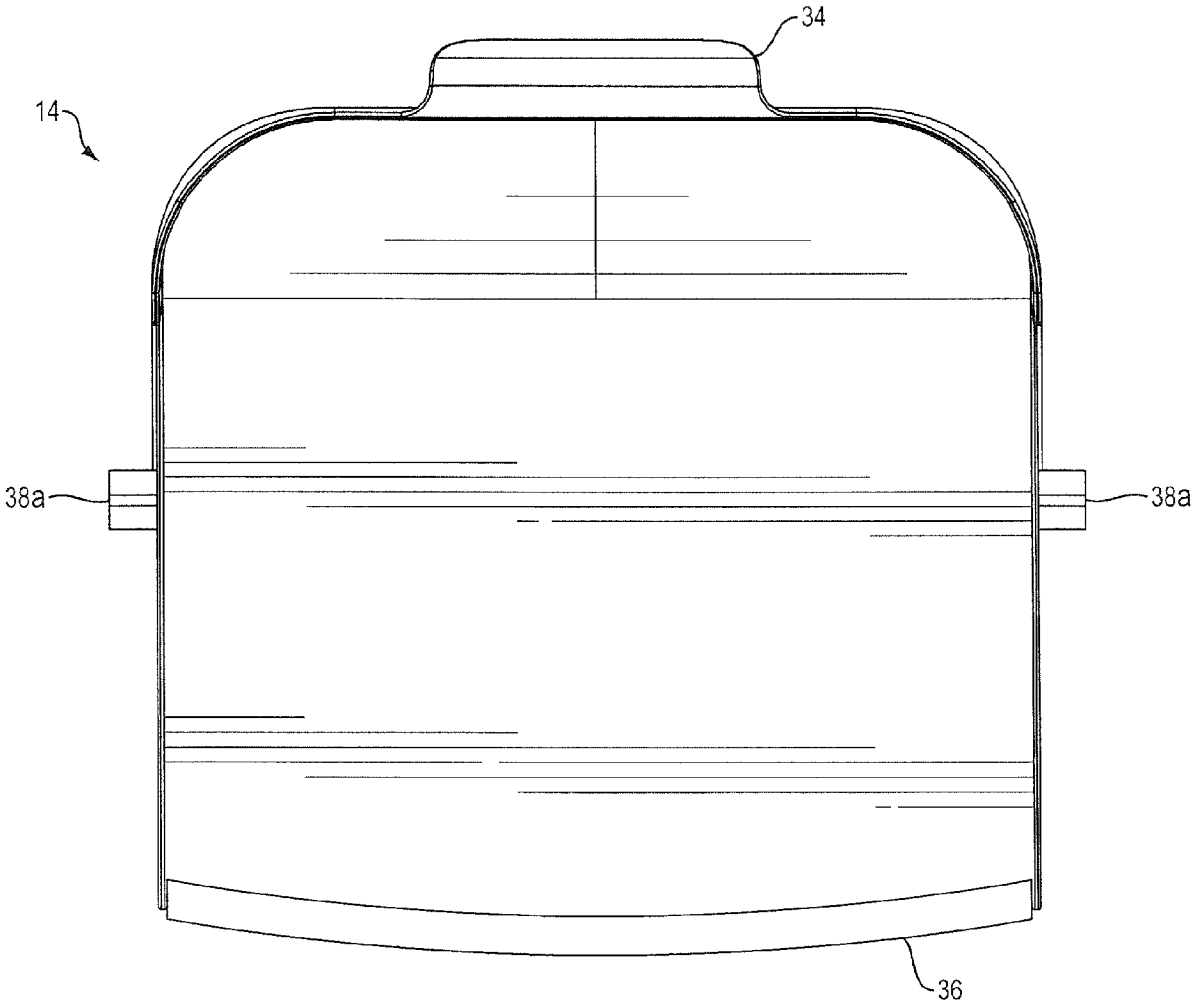
FIG. 10B is a bottom view of another embodiment of the lid when it has been removed from the cover to be used as a dust pan.

FIG. 10B depicts a lid 14*a* as seen when it is removed from its storage position and inverted for use independently as a dust pan. A handle 34 is shown opposing an edge 36 over which debris may be gathered. Lid 14*a* has protruding support posts 38*a* on opposing sides in place of the support post lots 38 of lid 14 in FIGS. 8, 9, and 10A.

Figure 11:
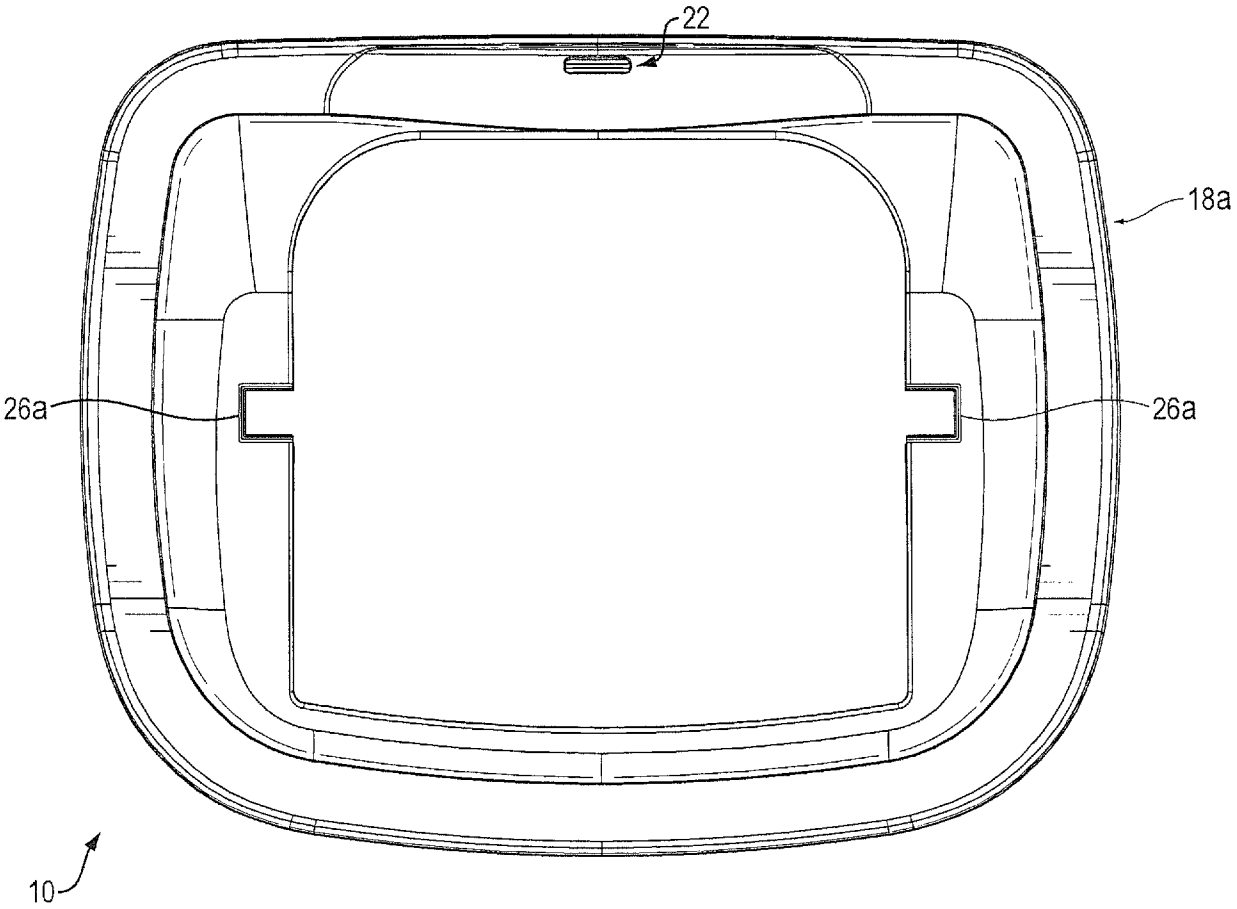
FIG. 11 is a top view of an embodiment of a cover with the lid removed.

FIG. 11 shows a top view of an embodiment of the receptacle top 10 with cover 18*a*, brush storage location 22, and support post slots 26*a* in place of the support posts 26 of cover 18 shown in FIGS. 2-6.

Figure 12:
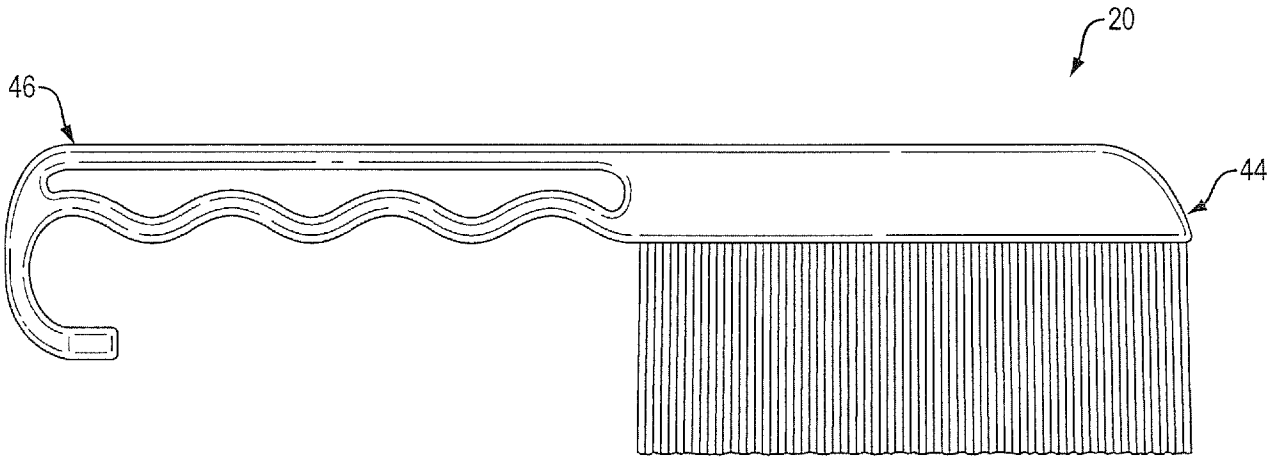
FIG. 12 is an embodiment of a brush.

FIG. 12 shows an embodiment of a brush 20 with a bristle end 44 and a handle end 46.

Figure 13:
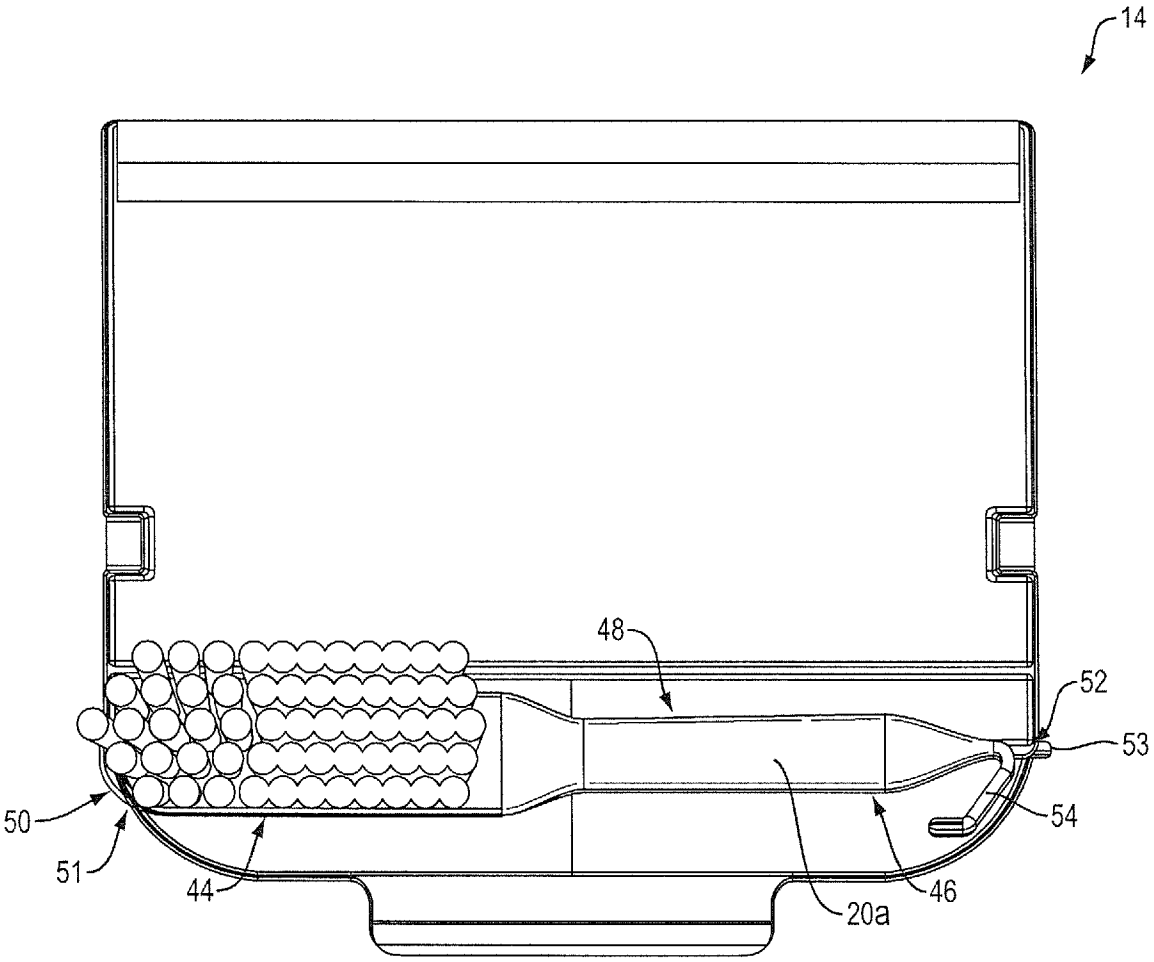
FIG. 13 is a view of a lid when being used as a dust pan with a brush secured in its storage location.

FIG. 13 shows a view of an embodiment of a lid 14 with an alternate brush storage location 48 within the body of the lid 14 for an alternate embodiment of a brush 20*a*. In this embodiment, when the brush 20*a* is in this alternate brush storage location 48 within the body of the lid 14, the bristle end 44 and handle end 46 of the brush 20*a* extend through a securing slot 51 and securing hole 52, respectively, thereby locking the brush 20*a* in place within the lid 14. When the lid 14 is away from its storage position for use independently as a dust pan, the brush 20*a* may be easily released from the lid 14 by removing the bristle end 44 of the brush 20*a* from a securing slot 51 in the lid 14 or it may be released by removing the handle end 46 of the brush 20*a* from a securing hole 52 in the lid 14. This embodiment of the brush 20*a* also includes a hanging mechanism 54 which can be used to store the brush 20*a* as shown in FIGS. 2, 3, 5, and 11. The alternate brush storage location 48 allows the brush 20*a* to be secured with the lid 14 during shipment as well as when the lid 14 is removed from its storage position and used independently as a dust pan.

Figure 14B:
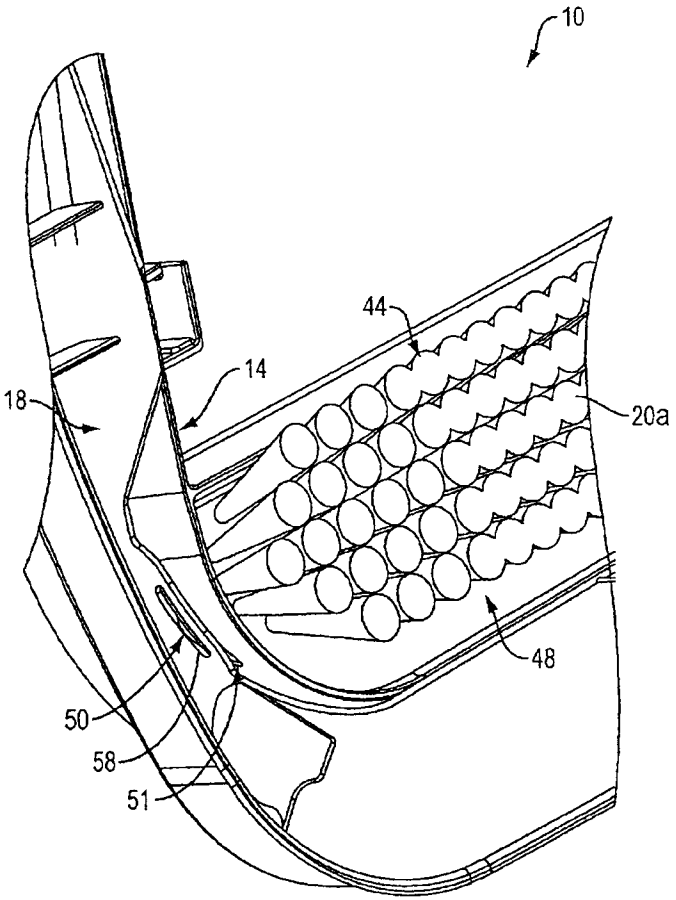
FIG. 14B is a view of an embodiment of the bristle end of the brush secured in the slots of the lid and the cover.
Figure 14A:
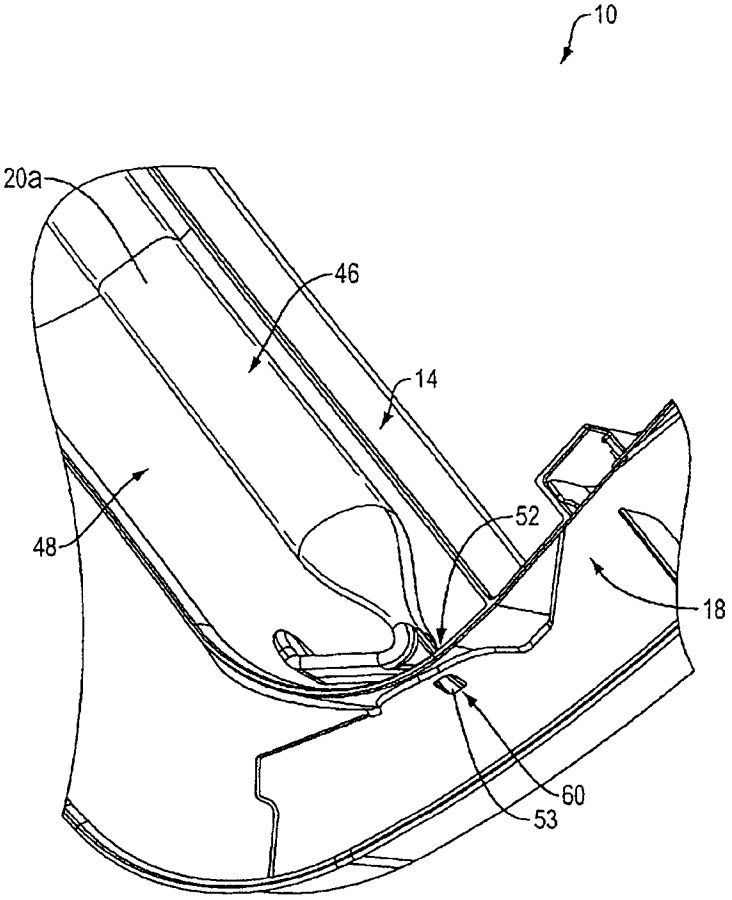
FIG. 14A is a view of an embodiment of the handle end of the brush secured in the holes of the lid and the cover.

FIGS. 14A-B show detailed illustrations of a receptacle top 10 securing together the brush 20*a*, the lid 14, and the cover 18 for shipment. FIG. 14A shows an embodiment of the handle end 46 of a brush 20*a* stored in the alternate storage location 48 within the lid 14 with the securing pin 53 of the brush 20*a* extending through the securing hole 52 in the lid 14 and into a secondary securing hole 60 in the cover 18. FIG. 14B shows an embodiment of the bristle end 44 of a brush 20*a* stored in the alternate storage location 48 within the lid 14 with the securing edge 50 of the brush 20*a* extending through a securing slot 51 in the lid 14 and into a secondary securing slot 58 in the cover 18.

What is claimed is:

1. A receptacle top, comprising:

a cover that is constructed and arranged to engage with a top rim of an open-top receptacle, to act as a closure for the receptacle, the cover having an opening and at least one secondary securing opening;

a lid that has sidewalls, each sidewall having a sidewall securing opening;

a brush that has at least one protrusion;

wherein the cover is constructed and arranged to support the lid over the opening of the cover when the lid is in a storage position;

wherein the lid functions as a dust pan when it is removed from the storage position;

wherein at least one protrusion can be fitted through at least one of the sidewall securing openings to releasably hold the brush in the lid; and wherein the secondary securing opening is constructed and arranged to align with at least one sidewall securing opening when the lid is in the storage position so that at least one brush protrusion can be fitted through at least one of the sidewall securing openings and at least one secondary securing opening to releasably hold the brush in the lid and the lid in the cover.

2. The receptacle top of claim 1 wherein the cover further comprises an outer edge which extends downward over the top rim of the receptacle, the outer edge extending around the perimeter of the cover.

3. The receptacle top of claim 2 wherein the cover further comprises a flat portion with a reverse side which rests upon the top rim of the receptacle, the flat portion directly adjacent and connected to the outer edge of the cover.

4. The receptacle top of claim 3 wherein the cover further comprises a brush storage location.

5. The receptacle top of claim 4 wherein the cover further comprises at least two support posts that are adjacent to the opening of the cover.

6. The receptacle top of claim 5 wherein the lid further comprises at least two support post slots which rest on the cover support posts when the lid is in the storage position.

7. The receptacle top of claim 4 wherein the cover further comprises at least two support post slots that are adjacent to the opening of the cover.

8. The receptacle top of claim 7 wherein the lid further comprises at least two support posts which rest on the cover support post slots when the lid is in the storage position.

9. The receptacle top of claim 4 wherein the lid comprises an edge over which debris may be swept when the lid is functioning as a dust pan.

10. The receptacle top of claim 9 wherein the lid further comprises a handle opposing the edge.

11. The receptacle top of claim 10 wherein the brush has a handle end and a bristle end.

12. The receptacle top of claim 11 wherein the brush further comprises a hanging mechanism on the handle end.

13. The receptacle top of claim 12 wherein the brush hanging mechanism is a hook or a clasp or a hole.

14. A receptacle top, comprising:

a) a cover that is constructed and arranged to engage with a top rim of an open-top receptacle, to act as a closure for the receptacle, the cover constructed and arranged with an opening, the cover comprising:
   i) an outer edge which extends downward over the top rim of the receptacle, the outer edge extending around the perimeter of the cover;
   ii) a flat portion with a reverse side which rests upon the top rim of the receptacle, the flat portion directly adjacent and connected to the outer edge of the cover;
   iii) a brush storage location;
   iv) at least two support posts adjacent to the cover opening;
   v) at least two secondary securing openings;

b) a lid that has at least two support post slots which rest on the cover support posts when the lid is in the storage position, and that functions as a dust pan when it is removed from the storage position, the lid comprising:
   i) an edge over which debris may be swept;
   ii) a handle opposing the edge;
   iii) two sidewalls, each sidewall having a sidewall securing opening;

c) a brush comprising:
   i) a handle end with a hanging mechanism comprised of a hook or a clasp or a hole; and
   ii) two protrusions; wherein the brush protrusions can be fitted through the sidewall securing openings to releasably hold the brush in the lid; and wherein the brush protrusion can be fitted through the sidewall securing openings and the secondary securing openings to releasably hold the brush in the lid and the lid in the cover.

* * * * *